US005855211A

United States Patent [19]

Nelson

[11] Patent Number: 5,855,211

[45] Date of Patent: Jan. 5, 1999

[54] ATTACHMENT UNIT FOR HAIR REPLACEMENT

[75] Inventor: Charles W. Nelson, Lee's Summit, Mo.

[73] Assignee: Apollo Products, Inc., Kansas City, Mo.

[21] Appl. No.: 24,201

[22] Filed: Feb. 17, 1998

[51] Int. Cl.[6] ..... A41G 3/00; A41G 5/00

[52] U.S. Cl. ..... 132/53; 132/54; 132/201

[58] Field of Search ..... 132/53, 54, 55, 132/56, 201

[56] References Cited

U.S. PATENT DOCUMENTS 3,970,092 7/1976 Nelson .
4,254,784 3/1981 Nelson .
4,372,330 2/1983 Nelson .
4,739,777 4/1988 Nelson .
4,976,621 12/1990 Wieneke .

*Primary Examiner*—Gene Mancene
*Assistant Examiner*—Philogene Pedro
*Attorney, Agent, or Firm*—Hovey, Williams, Timmons & Collins

[57] ABSTRACT

A hairpiece includes a foundation having a central portion and a circumscribing flap and further including an apron extending from the lower face of the foundation adjacent the flap and circumscribing a portion of the central area. The apron includes slits for receiving hair therethrough from adjacent a bald area on a person's head for anchoring the hairpiece on the bald area. The flap folds over and covers the apron with adhesive therebetween to hold the hair received through the slits in the anchoring position.

13 Claims, 1 Drawing Sheet

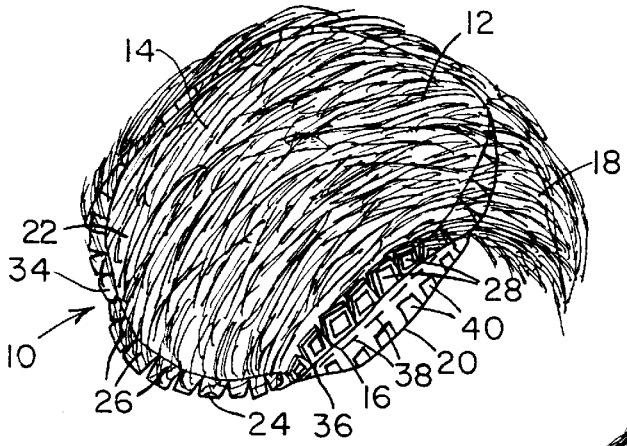
Fig. 1.
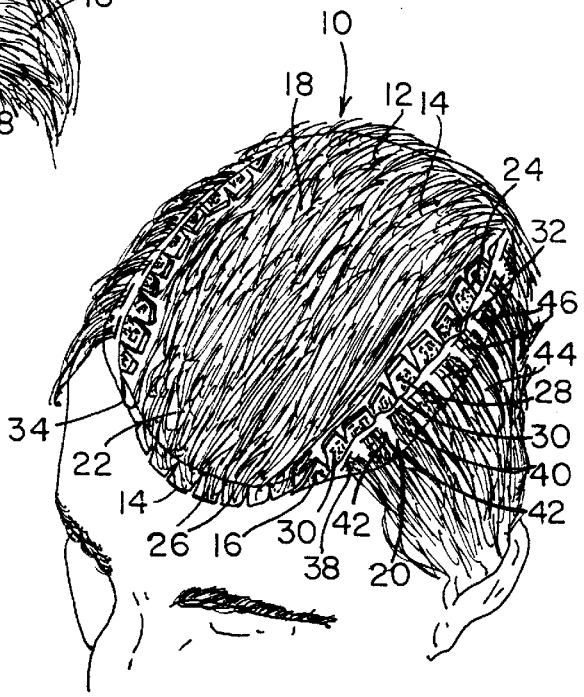
Fig. 2.
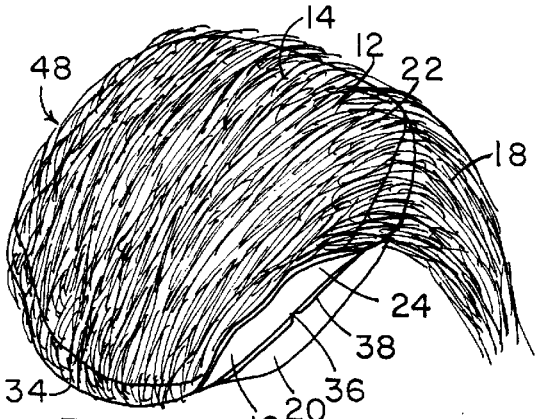
Fig. 4.
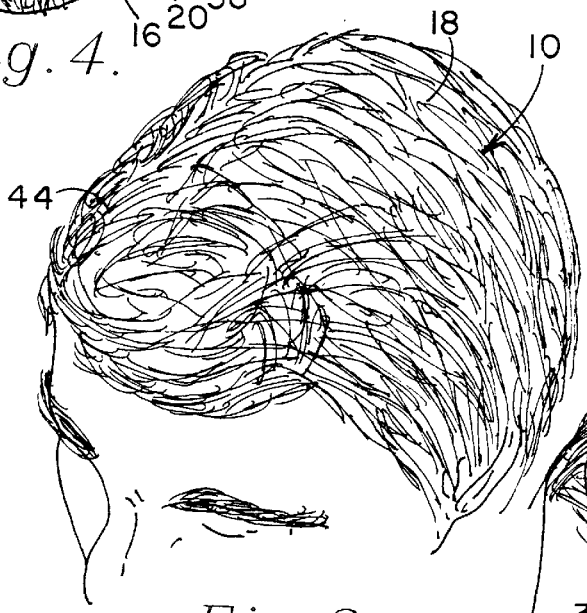
Fig. 3.
Fig. 5.
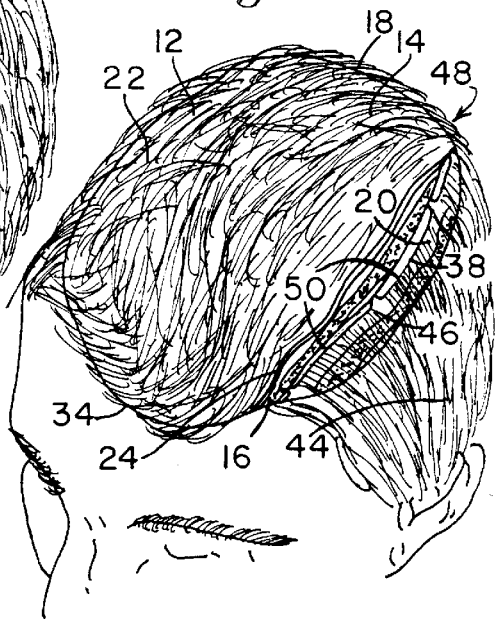

ATTACHMENT UNIT FOR HAIR REPLACEMENT

RELATED APPLICATIONS

Not applicable

FEDERALLY SPONSORED RESEARCH OR DEVELOPMENT

Not applicable

MICROFICHE APPENDIX

Not applicable

BACKGROUND OF THE INVENTION

1. Field of the Invention

The present invention deals with the field of hairpieces. In particular, the invention is concerned with a hairpiece including a foundation having a central portion and a circumscribing flap and further including an apron extending from the lower face of the foundation adjacent the flap and circumscribing a portion of the central area. The apron includes slits for receiving hair therethrough from adjacent a bald area on a person's head for anchoring the hairpiece on the bald area. The flap folds over and covers the apron with adhesive therebetween to hold the hair received through the slits in the anchoring position.

2. Description of the Prior Art

In the field of hairpieces, the prior art discloses a variety of techniques for holding a hairpiece in position on a bald area on a person's head. Some of these techniques are not appropriate for all circumstances and others may be ineffective. Still other techniques are time consuming to implement.

SUMMARY OF THE INVENTION

The present invention solves the prior art problems mentioned above and provides a distinct advance in the state of the art. In particular, the hairpiece hereof enables effective and time-efficient anchoring to a bald area having adjacent hair.

The preferred hairpiece includes a foundation having a central portion and a circumscribing flap and further includes an apron extending from the lower face of the foundation adjacent the flap and circumscribing a portion of the central area. The apron includes slits for receiving hair therethrough from adjacent a bald area on a person's head for anchoring the hairpiece on the bald area. The flap folds over and covers the apron with adhesive therebetween to hold the hair received through the slits in the anchoring position.

In one embodiment, the adhesive is in the form of a bead of adhesive between the flap and apron positioned to engage hair extending through the slits hold the hair in the anchoring position. In another embodiment, the flap is configured into a plurality of segments in registration with the slits defined in the apron. Each segment includes a section of tape with adhesive on the exposed face thereof. The apron also includes tape sections in registration with the tape sections of the flap segments. The registered tape segments hold the hair extending through the slits in the anchoring position. Other preferred aspects of the present invention are disclosed herein.

BRIEF DESCRIPTION OF THE DRAWINGS

FIG. 1 is a pictorial view of a first embodiment of a preferred hairpiece in accordance with the present invention;

FIG. 2 is a pictorial view of the hairpiece of FIG. 1 positioned on the bald area of a person;

FIG. 3 is a view similar to FIG. 2 showing the person's hair adjacent the bald area visually integrated with the filler hair of the hairpiece;

FIG. 4 is a pictorial view of a second embodiment of a preferred hairpiece in accordance with the present invention; and FIG. 5 is a pictorial view of the hairpiece of FIG. 4 positioned on the bald area of a person.

DETAILED DESCRIPTION OF THE PREFERRED EMBODIMENT

FIG. 1 illustrates preferred hairpiece 10 in accordance with the present invention. Hairpiece 10 includes foundation 12 presenting upper face 14 and lower face 16, replacement hair 18 extending from upper face 14, and apron 20. Foundation 12 includes central area 22 and flap 24 circumscribing central area 22.

Flap 24 extends from the periphery of central area 22 and is divided into a plurality of segments 26. Segments 26 include a respective plurality of tape sections 28 attached to lower face 16. Each tape section 28 includes an inboard surface with pressure sensitive adhesive attaching the section 28 to a respective segment 26, and an outboard or exposed surface 30 also presenting pressure sensitive adhesive. Each exposed surface 30 includes a release liner 32 thereon which is removed during the fitting on a person.

Apron 20 extends from foundation lower face 16 and circumscribes central area 22 except for forward edge 34. Apron 20 presents about the same width as flap 24 with juncture 36 therebetween, and includes a plurality of spaced, hair-receiving apertures or slits 38 distributed therealong in registration with segments 26. Apron 20 also includes a plurality of tape sections 40 (of the same type as tape sections 28) attached thereto and positioned respectively between slits 38 and the edge of apron 20. Sections 40 present exposed surfaces 42 respectively with pressure sensitive adhesive thereon and covered by a release liner until ready for use. As best viewed in FIG. 1, segments 26, tape sections 28, slits 38 and tape sections 40 are in registration about the periphery of central area 22 except for forward edge 34. Flap 24 and segments 26 individually are shiftable between a spaced position and an adjacent position relative to apron 20 about juncture 36.

FIG. 2 illustrates hairpiece 10 being fitted to the bald area of a person's head. As will be appreciated, hairpiece 10 generally conforms to the shape of the bald area in order to attain complete replacement coverage thereof. In the situation of typical pattern baldness, there is hair 44 adjacent the bald area. This adjacent hair 44 is used with the present invention for anchoring hairpiece 10 to the bald area.

In particular, for each slit 38 in apron 20, a strand 46 of the person's hair from adjacent the bald area and nearest a respective slit 38 is positioned through slit 38. That is, a respective strand 46 is inserted from the lower side of apron 20, pulled through an adjacent slit 38, and then pulled over an adjacent tape section 40 with the release liner in place thereon. This is repeated for all of slits 38.

Next, the release liner is removed from a respective tape section 40 on apron 20 and the adjacent strand 46 pulled downwardly into an anchoring position. In this position, strand 46 engages the pressure sensitive adhesive on exposed surface 42 of the tape sections 40. The pressure sensitive adhesive thereon holds this strand in the anchoring position. Working from side to side, this process is repeated until all of strands 46 are held in the anchoring position by the adhesive on a respective tape section 40.

The release liners are removed from segments 26 along forward edge 34 and pressed into place at the edge of the bald area adjacent a person's forehead. This holds the front of hairpiece 10 while the strands of hair are pulled snugly along the rearward edge.

Next, the release liners 32 are removed from tape sections 28 on flap segments 26. With the pressure sensitive adhesive now exposed, each segment 26 is shifted to the adjacent position and pressed against a respective hair strand 46. In this way, each strand is further held in the anchoring position between the exposed adhesive surfaces of respective tape sections 28 and 40.

With all of segments 26 folded downwardly, flap 24 covers apron 20. In the preferred embodiment, replacement hair 18 extends from upper face 14 including segments 26. This conceals the individual segments.

Finally, replacement hair 18 is commingled with the person's natural hair in order to present the visually integrated appearance illustrated in FIG. 3. In so doing, the presence of hairpiece 10 is concealed while it is held firmly in place without the need for concern that hairpiece 10 might become dislodged.

FIGS. 4 and 5 illustrate hairpiece 10 which is another embodiment in accordance with the present invention. Hairpiece 48 is similar to hairpiece 10 and similar components are shown with the same numerical designations in the drawing figures. The primary differences are that hairpiece 48 does not include segments 26 and tape sections 28 and 40. Instead, beads 50 of adhesive are used to hold strands 46 in the anchoring position as illustrated in FIG. 5. Flap 24 is then folded over apron 20. Adhesive beads 50 hold flap 24 and apron 20 in the adjacent position. Replacement hair 18 is then commingled with the person's natural hair as described above to present the visually integrated appearance illustrated in FIG. 3.

Those skilled in the art will appreciate that the present invention encompasses many variations in the embodiments described herein.

Having thus described these embodiments, the following is claimed as new and desired to be secured by Letters Patent:

1. A hairpiece comprising:

a foundation having an upper face and an opposed, lower face, and configured to conform to a bald area on a person's head having adjacent hair, said foundation including a central area and a flap circumscribing at least a portion of said central area;

filler hair extending from said upper face; and an apron extending from said lower face adjacent said flap and circumscribing at least a portion of said central area, said apron including a plurality of hair-receiving apertures defined therein for receiving hair adjacent the bald area therethrough in an anchoring position for anchoring said foundation and thereby said hairpiece to the bald area.

2. The hairpiece as set forth in claim 1, said flap and apron being joined at a juncture.

3. The hairpiece as set forth in claim 2, said flap and apron being shiftable relative to one another between a spaced position and an adjacent position, said flap being configured to cover said apron when in said adjacent position and allowing access to said apron including said apertures when in said spaced position.

4. The hairpiece as set forth in claim 1, said apertures including a plurality of slits distributed along said apron.

5. The hairpiece as set forth in claim 1 further including holding means for holding hair received through said apertures in said anchoring position.

6. The hairpiece as set forth in claim 5, said holding means including adhesive.

7. The hairpiece as set forth in claim 6, said holding means including at lease one bead of adhesive applied to said apron adjacent said apertures and to hair extending therethrough.

8. The hairpiece as set forth in claim 6 further including at least one tape section attached to said flap at said lower face, said tape section including an exposed surface, said adhesive including pressure sensitive adhesive on said exposed surface for engaging hair received through said apertures for holding the hair in said anchoring position.

9. The hairpiece as set forth in claim 8 including a plurality of said tape sections distributed along said lower face in registration with said apertures.

10. The hairpiece as set forth in claim 9, including a plurality of said tape sections distributed along said apron in registration with said tape sections of said flap for holding hair in said anchoring position between registered tape sections of said flap and apron.

11. The hairpiece as set forth in claim 1, said central area including a forward edge, said apron circumscribing said central area except for said forward edge.

12. The hairpiece as set forth in claim 1, said foundation including structure configuring said flap into a plurality of adjacent, separate segments.

13. The hairpiece as set forth in claim 1, said flap and apron being joined at a juncture and being shiftable about said juncture between a spaced position and an adjacent position, said flap being configured for covering said apron when in said adjacent position, said foundation including structure configuring said flap into a plurality of adjacent, separated, independently shiftable segments in registration with said apertures, said segments including respective tape sections attached to said lower face thereof, each tape section having an exposed surface with adhesive thereon, said hairpiece further including a plurality of said tape sections attached to said apron respectively adjacent said apertures and in registration with said tape sections of said flap segments for holding hair between registered tape sections in said anchoring position when said segments and apron are in said adjacent position.

* * * * *